United States Patent [19]

Forjot

[11] Patent Number: 4,545,575

[45] Date of Patent: Oct. 8, 1985

[54] APPARATUS FOR LEARNING TO SKI

[76] Inventor: Roland Forjot, 117 avenue de Rimiez, 06100 Nice, France

[21] Appl. No.: 478,213

[22] Filed: Mar. 23, 1983

[30] Foreign Application Priority Data

Mar. 26, 1982 [FR] France ..... 82 05486

[51] Int. Cl.[4] ..... A63B 7/00; B61B 13/00

[52] U.S. Cl. ..... 272/97; 272/109; 272/70.4; 104/91

[58] Field of Search ..... 272/70, 70 A, 97, 109, 272/24, 61, 56.5 SS, 103, 62, 63; 104/91, 94

[56] References Cited

U.S. PATENT DOCUMENTS

| | | | |
|---|---|---|---|
| 649,914 | 5/1900 | Delmore | 272/109 |
| 1,352,969 | 8/1920 | Kalix | 104/91 |
| 2,478,004 | 8/1949 | Newell | 272/70 A |
| 3,222,064 | 12/1965 | Langton | 272/103 |
| 3,780,663 | 12/1973 | Pettit | 272/70 A |
| 3,861,318 | 1/1975 | Massa | 272/97 |
| 4,410,175 | 10/1983 | Shamp | 272/70 |

FOREIGN PATENT DOCUMENTS

| | | | |
|---|---|---|---|
| 469464 | 12/1928 | Fed. Rep. of Germany . | |
| 2659136 | 7/1978 | Fed. Rep. of Germany | 272/109 |
| 34840 | 10/1929 | France . | |
| 41775 | 1/1933 | France | 272/70 A |
| 9426 | of 1909 | United Kingdom | 272/70 A |
| 13694 | of 1909 | United Kingdom . | |

*Primary Examiner*—Richard J. Apley
*Assistant Examiner*—S. R. Crow
*Attorney, Agent, or Firm*—Young & Thompson

[57] ABSTRACT

Apparatus for learning to ski, comprising a harness (2) which sustains the skier (1) who is unbalanced just prior to a fall, the harness being connected to a movable carriage (6) by retention straps (13*a*). The carriage (6) moves on a roller track which serves as a rail (8). The carriage (6) is mounted on rollers and comprises brakes (10*a*). The brakes (10*a*) may be automatically actuated by the beginning of a fall of the skier (1), the retention straps (13*a*) being connected to the brakes (10*a*).

4 Claims, 5 Drawing Figures

APPARATUS FOR LEARNING TO SKI

The invention has for its object an apparatus for learning to ski.

In all equilibrium sports: bicycling, roller skating, ice skating, horseback riding, swimming, trapeze, etc., it is possible to learn the sport with the aid of means for avoiding or reducing the risk of a fall.

Until now, no such means was available for learning to ski. Thus, no effective external assistance was available.

Of course there are a number of devices for gymnasia permitting performance of skiing movements to prepare and/or to maintain the muscles. Of course these are not utilizable on the ground. The most complicated apparatus is that disclosed in the French patent of W. M. Rice No. 2,210,315. It comprises a simulator which permits the user to reproduce the efforts and movements of a skier. Other devices tend to reduce the speed of descent, for a less experienced skier, by a jacket which serves as a braking means. These devices do not assist in learning to ski on the ground.

The invention overcomes all these drawbacks. It permits learning to ski without fear of speed and/or falling. It permits studying which are the desirable and undesirable movements, and this, on the ground while sliding.

The apparatus according to the invention is comprised by harness means for the user, which is connected by spring means and retainer straps, to a movable carriage which moves on a roller track, disposed in a suitable way according to the direction of the slope on which the skier normally slides. Said roller track can be mounted on an upright frame, in the case in which said roller track is an aerial rail. The roller track may be disposed laterally with respect to the skier, or in the ground. In the latter two cases, a shaft is secured to the movable carriage, said shaft has a suitable shape to support and maintain the skier in the case of any fall. Brake means and/or blocking means may act on said carriage and thus arrest the descent of the skier; said braking means and/or blocking means may be manually or automatically actuated at the onset of the skier's fall. Said harness comprises retention straps which are adjusted so that the skier will not completely fall, and so that he will not be impeded in his movements. With the retention straps may be combined means serving as springs such as rubber strips which permit a skier to feel himself continuously supported without being impeded in his movements, before being caught in the case of a fall by the straps themselves.

Said retention straps actuate shoes which brake and/or block the movement of the carriage on its roller track.

The movable carriage comprises a chassis mounted on rollers. Said rollers and the chassis are a function of the shape of the roller track. The braking of the carriage is effected by means of at least two shoes, rubber blocks or the like, situated on each side of the perpendicular portion of the rollerway. The roller track may be a rail or an I-beam. The action of the shoes is controlled by a cross bar secured to each end of the shoes. On each side of the cross bar, holes are provided so as to permit the securement of one end of the retention straps. The various holes acting on the arms of the lever, formed by the cross piece, permit regulating the triggering of the brake as a function of the weight of the user and only in case of danger of a fall.

Manual means such as a cable acting by a lever at the level of the chassis of the carriage loose the brake shoes which are in closed position by action of a spring; by pulling on the cable, the shoes open and the carriage can roll.

Thanks to the invention described below, it will be possible to learn to ski without the least fear of falling and to obtain in a relatively short time equilibrium on the two skis or on a monoski. It will also be possible to improve and to develop completely and without danger.

The accompanying drawings, given by way of non-limitative example, permit easy comprehension of the invention. They show a preferred embodiment according to the invention.

Figure 1:
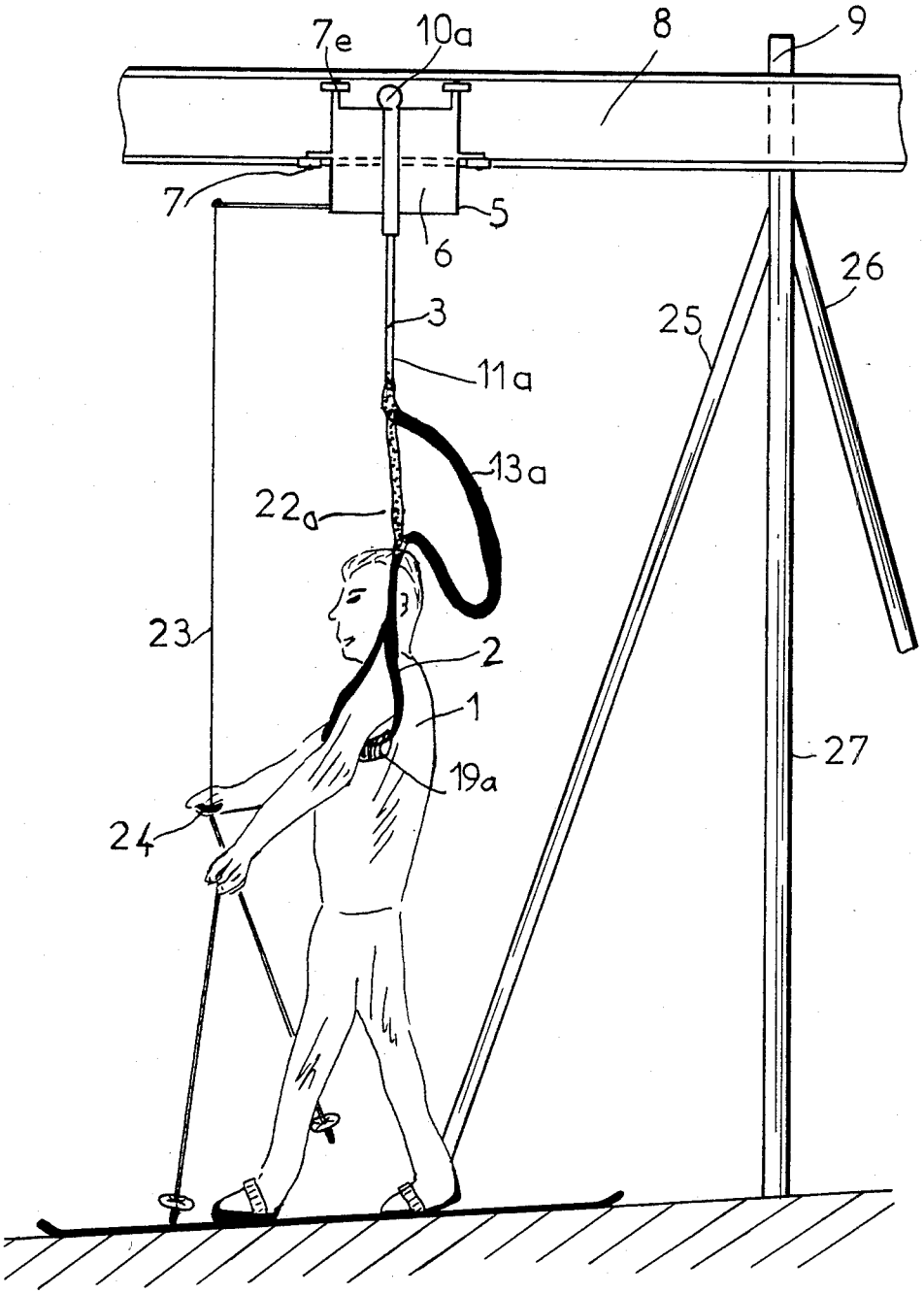
FIG. 1 is a schematic view of the apparatus, viewed from the side.
Figure 2:
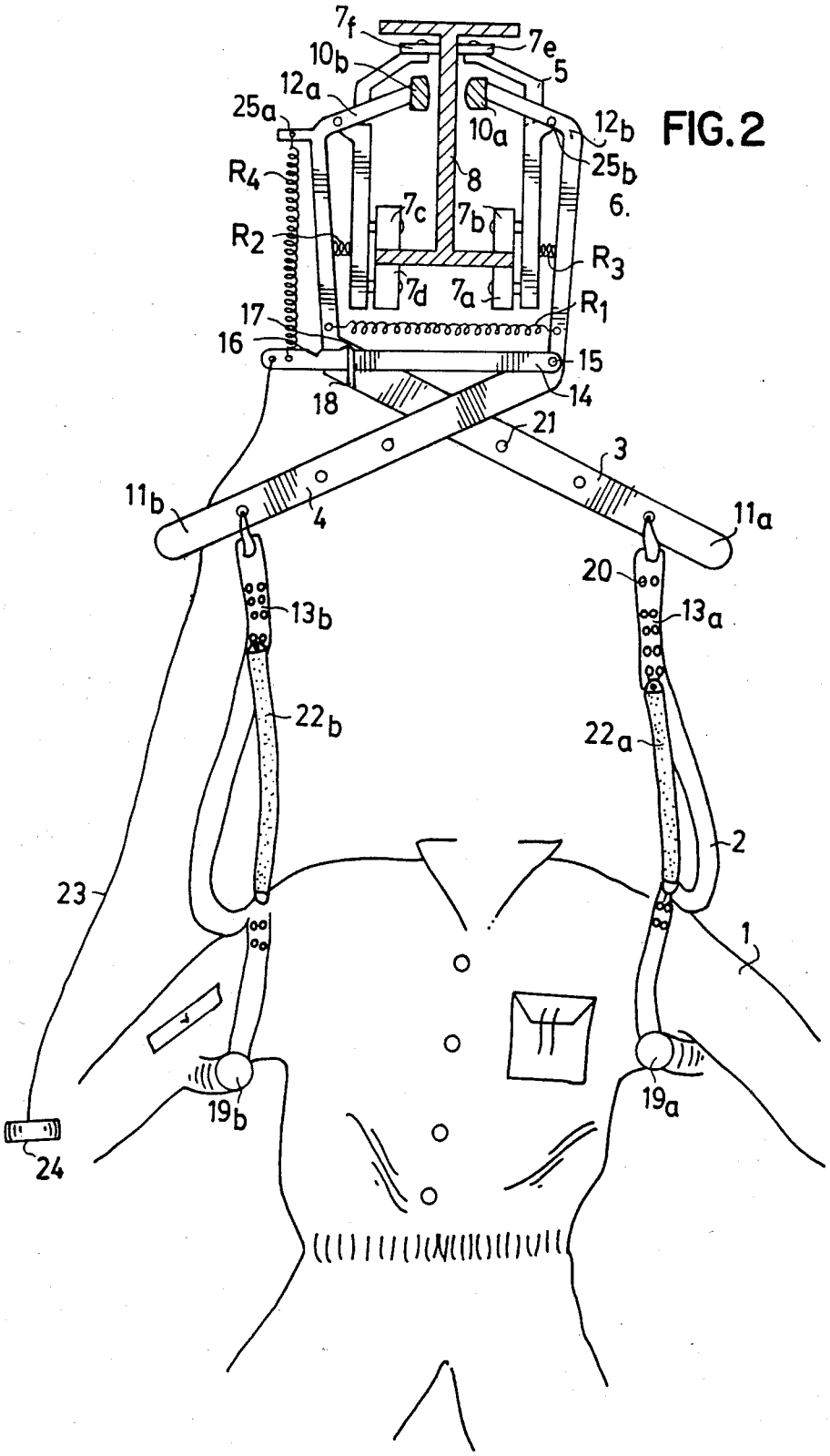
FIG. 2 is a front view of the apparatus, the carriage brakes being unlocked.
Figure 3:
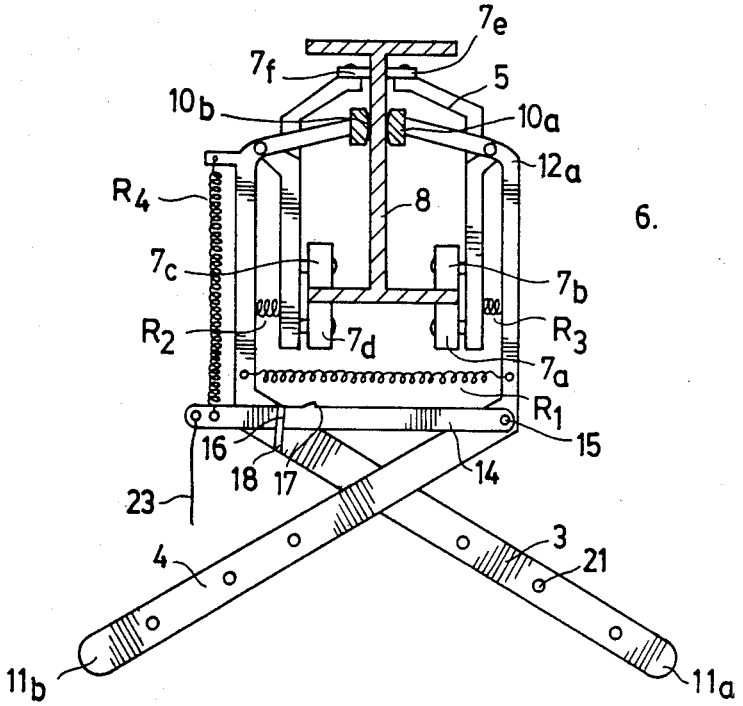
FIG. 3 is a front view of the apparatus, the carriage brakes being locked.

The skier 1 wears as harness means 2, retention straps 13*a*, 13*b* which are fixed at the end 11*a*, 11*b* of each cross bar 3 and 4. These cross bars 3 and 4 are securely mounted on chassis 5 of a movable carriage 6. Said movable carriage 6 is mounted on rollers 7*a*, 7*b*, 7*c*, 7*d*, 7*e*, 7*f*, which permits it to roll on the roller track 8, which serves as an aerial rail. This roller track 8 is maintained in position and at an appropriate height by an upright support frame 9.

The movable carriage 6 may be braked by brake shoes 10*a*, 10*b*, which are mounted at the other end 12*a*, 12*b* of the cross bars 3 and 4. Said cross bars 3 and 4 are pivotally mounted on chassis 5 of the movable carriage 6, on axles 25*a* and 25*b*. A spring $R_1$ tends to move the brake shoes 10*a*, 10*b* relative to the vertical web of rail 8, while two springs $R_2$ and $R_3$, acting oppositely, tend to effect the engagement of the shoes. A lever 14 pivotally mounted on cross bar 4 by its axle 15, has notches 16 and 17 which register with a pawl 18 disposed at this level on the other cross bar 3. A spring $R_4$ urges lever 14 upwardly, which is to say with pawl 18 engaged in one or the other of the notches 16 or 17.

The operation of the device is simple. The skier passes the harness comprised by the retention straps 13*a*, 13*b* under the armpits; said straps 13*a*, 13*b* may comprise pads 19*a*, 19*b* so that the straps will not cut. Depending on the weight of the skier, the retention straps 13*a*, 13*b* are adjusted by means of holes 20. Depending on the weight of the skier, the retention straps 13*a*, 13*b* are engaged in different holes 21 of the cross bars 3 and 4. It will be understood that the lever arm is greater, when the straps 13*a*, 13*b* are engaged at the ends 11*a*, 11*b* of the cross bars 3 and 4, the lighter is the skier, and vice versa. So that the skier will feel himself continuously supported, the retention straps 13*a*, 13*b* may comprise spring means, which are stretchers 22*a*, 22*b*, which maintain a continuous weak tension no matter what the movements of the skier. These stretchers 22*a*, 22*b* absorb the movements and the normal travel of the skier; but it is only at the beginning of a fall, when the stretchers are fully extended, that the retention straps 13*a*, 13*b* come into action and hence the brakes 10*a*, 10*b*.

The skier, to start again, can pull on the cable 23 by a handle 24. This cable 23 lowers the control lever 14 which frees the pawl 18 from its notch 16, the brakes unlocking under the action of lever 14 which resets the cross pieces 3 and 4 while stretching spring $R_4$.

At the beginning of a fall, the retention straps 13*a*, 13*b* actuate the cross bars 3 and 4, freeing the pawl 18 from its notch 17, the weight of the skier applying the brake shoes 10*a*, 10*b* to the rail 8.

Thus, as soon as the skier loses balance, his fall is immediately arrested by the straps and his movement is stopped, because the movement of his fall actuates the brake of the movable carriage.

It should be noted that the braking means with an actuating lever having notches 16, 17 and a pawl 18, avoids a progressive braking which might necessarily be provoked by the position of the skier in action.

The upright frame 9 is constituted by two metallic tubes 25, 26 connected and welded together by a tube 27 of the same diameter, which is vertical and supports the rail 8. These tubes 25, 26, 27 may be slidably disposed in other tubes 28, secured to the ground, and which serve as hydraulic pistons 29 thus permitting the assembly of the upright frame 9 to rise, to maintain a useful height, under the rail 8, no matter what the height of the snow. The stability of frame 9 may be ensured by a tripod on which side, formed by three tubes, of which the central tube 28 is that which receives the vertical tube 27 of frame 9, or simply by two metal stays.

Figure 4:
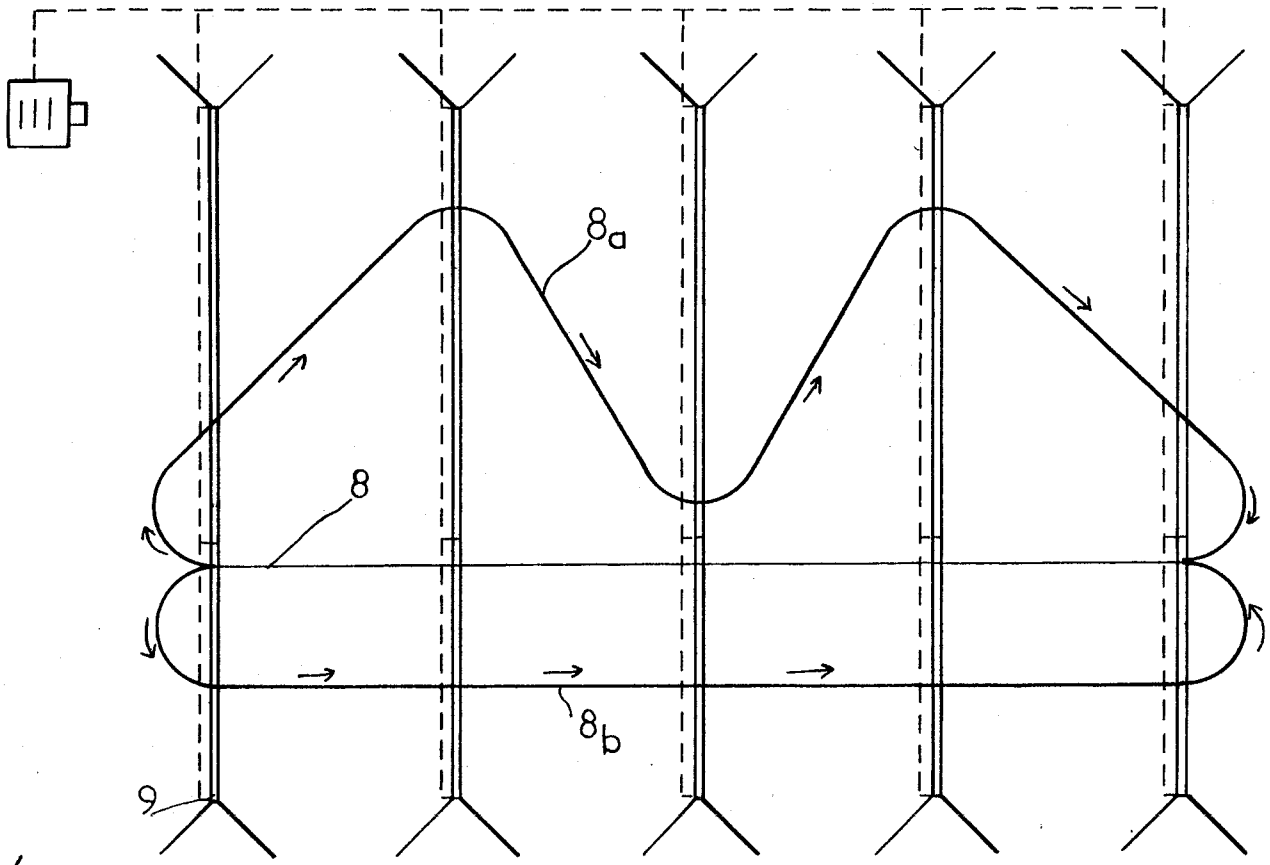
FIG. 4 is a schematic view of the arrangement of the upright frames for one or more roller tracks.
Figure 5:
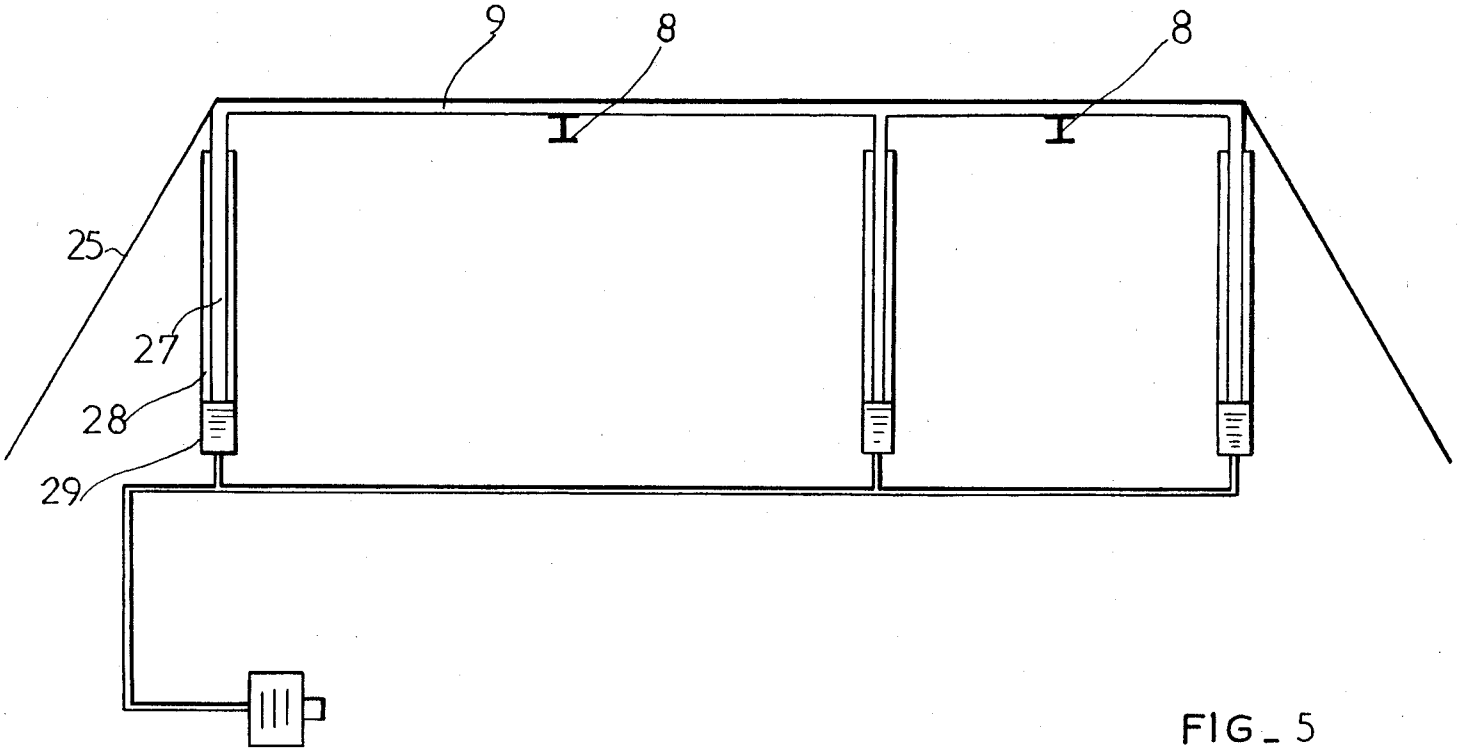
FIG. 5 is a schematic view in cross section of the arch of a frame mounted on hydraulic jacks to keep the same height, useful no matter what is the height of the snow.

In FIG. 4 is shown a course of the "slalom" type 8*a*, and a straight course 8*b* to practice turns or to improve speed. The assembly of rails 8, 8*a* and 8*b* is supported by several frames 9, which are mounted on hydraulic jacks. The hydraulic installation is shown in dotted line in FIG. 4. The movable carriages may use for their return a single ascent rail 8.

The apparatus may of course be used not only for beginners, but also for physically handicapped people.

Although not shown, it is easy to see that the roller track need not be aerial. It could be located laterally with respect to the skier or on the ground. In this case, a shaft is mounted on a movable carriage which runs on the roller track. Said shaft has a suitable shape to support and maintain the skier prior to a fall.

What is claimed is:

1. Apparatus for learning to ski, characterized by the fact that it comprises harness means (2) which permit supporting the skier (1) off balance just before his fall, said harness means being connected to a movable carriage (6) by means of retention straps (13*a*, 13*b*), said carriage (6) being movable on a roller track which serves as a rail (8), in which the carriage (6) is mounted on rollers, and comprises brake means (10*a*, 10*b*), and in which, in order to adjust the application and/or release of the brake means (10*a*, 10*b*) as a function of the weight of the skier, cross bars (3 and 4) having several holes (21) are disposed along the longitudinal axis, and in which oppositely acting springs ($R_1$, $R_2$and $R_3$, $R_4$) and an actuating lever (14), having notches (16, 17) which cooperate with a pawl (18), permit exact adjustment of the moment at which the retention straps (13*a*, 13*b*) will act on the cross bars (3 and 4) so as to apply the brake means (10*a*, 10*b*) on a vertical wall of said rail (18).

2. Apparatus for learning to ski, characterized by the fact that it comprises harness means (2) which permit supporting the skier (1) off balance just before his fall, said harness means being connected to a movable carriage (6) by means of retention straps (13*a*, 13*b*), said carriage (6) being movable on a roller track which serves as a rail (8), in which the carriage (6) is mounted on rollers, and comprises brake means (10*a*, 10*b*), and in which the retention straps (13*a*, 13*b*) are secured to the ends of two cross bars (3 and 4) which at their other ends (12*a*, 12*b*) carry brake shoes (10*a*, 10*b*), the assembly of cross bars (3, 4) and shoes (10*a*, 10*b*) being mounted on the chassis (5) of the movable carriage (6), pivotably about axles (25*a*, 25*b*), and in which a lever (14) mounted pivotally on one said cross bar (4) by its axis (15) has notches (16 and 17) which register with a pawl (18), which is at this level on the other cross bar (3); a spring ($R_4$) acting to maintain the lever (14) raised in a position in which the pawl (18) is engaged in one or the other of the notches (16 or 17).

3. Apparatus for learning to ski according to claim 1, characterized by the fact that one spring ($R_1$) tends to move the brake means (10*a*, 10*b*) relative to said vertical wall of the rail (8), while two oppositely acting springs ($R_2$ and $R_3$) tend to move the brake means in the opposite direction.

4. Apparatus for learning to ski according to claim 2, characterized by the fact that after applying the brake means, the skier, to start again, can pull on a cable (23) by means of a handle (24), this cable (23) lowering the control lever (14) which frees the pawl (18) from its notch (16), the brake means releasing under the action of lever (14) which resets the cross bars (3 and 4).

* * * * *